US006676247B2

(12) United States Patent
Sakuma

(10) Patent No.: US 6,676,247 B2
(45) Date of Patent: Jan. 13, 2004

(54) HEAD CHIP

(75) Inventor: Katsuhisa Sakuma, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 10/124,353

(22) Filed: Apr. 16, 2002

(65) Prior Publication Data

US 2003/0063164 A1 Apr. 3, 2003

(30) Foreign Application Priority Data

Apr. 27, 2001 (JP) ..... 2001-130756

(51) Int. Cl.[7] ..... B41J 2/045
(52) U.S. Cl. ..... 347/68
(58) Field of Search ..... 347/54, 68–72; 29/25.35, 890.1

(56) References Cited

U.S. PATENT DOCUMENTS 4,887,100 A * 12/1989 Michaelis et al. ..... 347/69
5,625,393 A 4/1997 Asai ..... 347/69
5,646,661 A * 7/1997 Asai et al. ..... 347/69

FOREIGN PATENT DOCUMENTS

GB 2362610 11/2001
JP 0852872 2/1996
JP 00168094 6/2000

OTHER PUBLICATIONS

English translated document of Japanese Document 08–052872.*

* cited by examiner

*Primary Examiner*—Stephen D. Meier
*Assistant Examiner*—An H. Do
(74) *Attorney, Agent, or Firm*—Adams & Wilks

(57) ABSTRACT

A head chip has a plurality of chambers provided in a piezoelectric plate, nozzles at ends of the chambers, electrodes in the chambers for applying a voltage to discharge ink from the nozzle openings, and an ink chamber plate joined to the piezoelectric plate for defining a common ink chamber communicating with the plural ink chambers, and having a partitioning portion for partitioning the chambers and the common ink chamber and communicating holes for defining a pump length according to a distance from the nozzle openings, so that converging time during which pressure in the ink chambers attenuates may be reduced to enable high speed printing without deteriorating ink discharge characteristics. In addition, by providing the communicating holes at equal intervals the converging time does not fluctuate even if the discharge amount is controlled based on the shape of the nozzle openings.

20 Claims, 11 Drawing Sheets

FIG. 10A
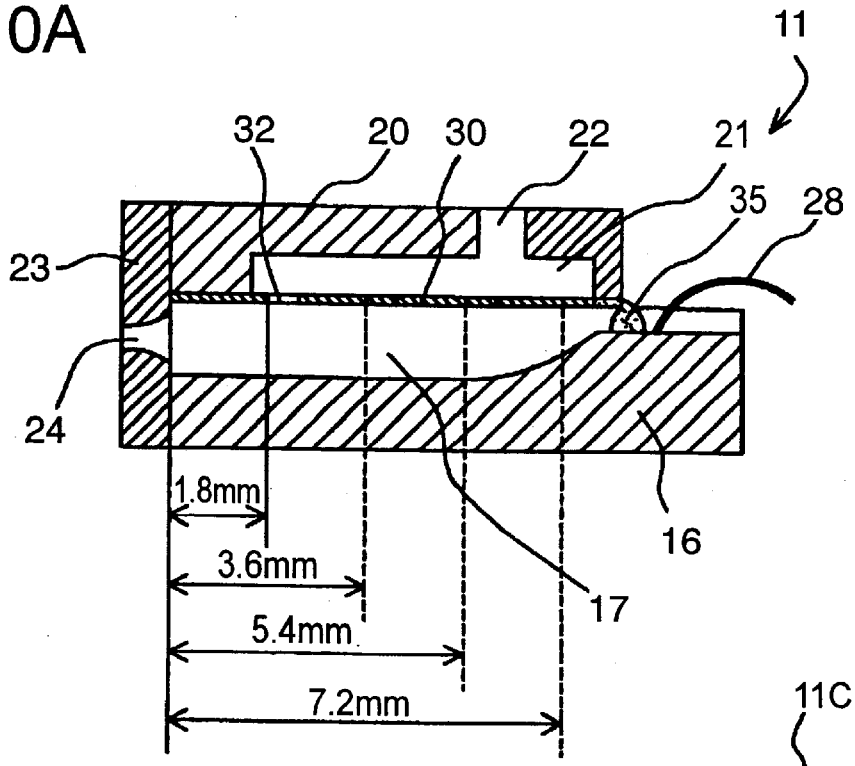
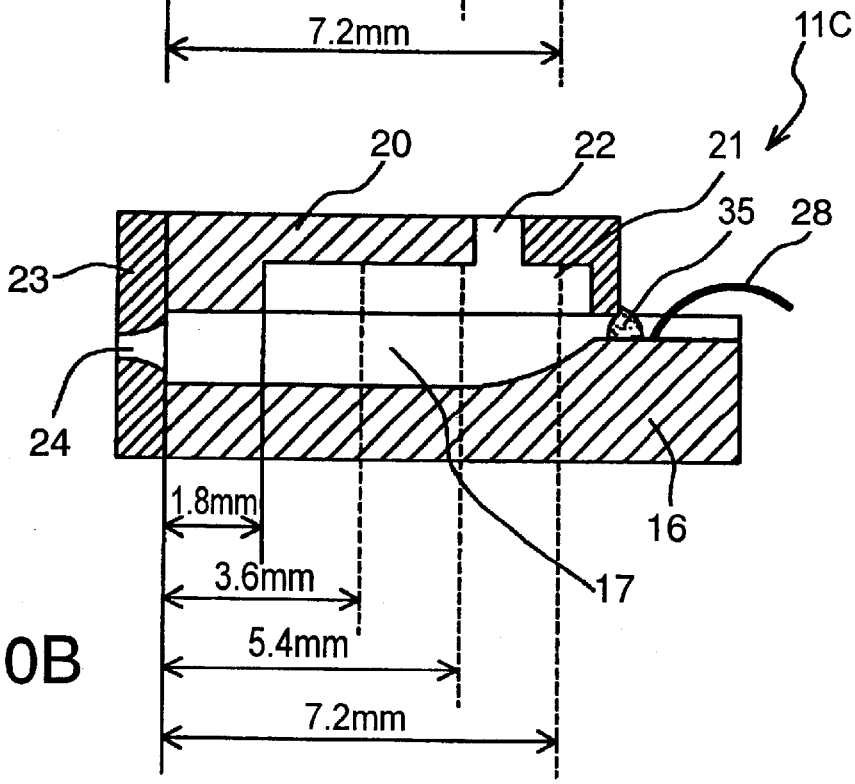
FIG. 10B

HEAD CHIP

BACKGROUND OF THE INVENTION

1. Field of the Invention

The present invention relates to a head chip that is mounted on an ink jet recording device applied to, for example, a printer or a facsimile.

2. Description of the Related Art

Conventionally, there is known an ink jet recording device that records characters and images on a medium to be recorded using an ink jet head having a plurality of nozzles for discharging ink. In such an ink jet recording device, the nozzles of the ink jet head are provided in a head holder so as to oppose the medium to be recorded, and this head holder is mounted on a carriage to be scanned in a direction perpendicular to a conveying direction of the medium to be recorded.

A schematic exploded view of an example of a head chip of such an ink jet head is shown in FIG. 12 and a sectional view of main parts of the same is shown in FIG. 13. As shown in FIGS. 12 and 13, a plurality of grooves 102 are provided in parallel with each other in a piezoelectric ceramic plate 101, and each groove 102 is separated by sidewalls 103. An end portion in the longitudinal direction of each groove 102 is extended to an end surface of the piezoelectric ceramic plate 101 and the other end portion is not extended to the other end surface, making the groove 102 to be gradually shallow. In addition, electrodes 105 for applying a driving electric field are formed on surfaces on opening side of both sidewalls 103 in each groove 102 throughout its longitudinal direction.

In addition, a cover plate 107 is joined on the opening side of the grooves 102 of the piezoelectric ceramic plate 101 via adhesive 109. The cover plate 107 includes a common ink chamber 111 to be a recessed portion communicating with the other end portion where each groove 102 is shallow and an ink supply port 112 that is bored from the bottom portion of this common ink chamber 111 in the direction opposite to the grooves 102.

In addition, a nozzle plate 115 is joined to an end surface of the joined body of the piezoelectric ceramic plate 101 and the cover plate 107 in which the grooves 102 are opened, and nozzle openings 117 are formed in the nozzleplate 115 at positions opposing the respective grooves 102.

Further, a wiring substrate 120 is fixed to the surface of the piezoelectric ceramic plate 101 on the other side of the nozzle plate 115 and on the other side of the cover plate 107. Wiring 122 connected to each electrode 105 via bonding wires 121 or the like is formed on the wiring substrate 120, and a driving voltage can be applied to the electrodes 105 via this wiring 122.

In a head chip configured in this way, when each groove 102 is filled with ink from the ink supply port 112 and a predetermined driving electric field is caused to act on the sidewalls 103 on both sides of the predetermined groove 102 via the electrode 105, the sidewalls 103 are deformed to change the capacity inside the predetermined groove 102, whereby the ink in the groove 102 is discharged from the nozzle opening 117.

For example, as shown in FIG. 14, if ink is discharged from the nozzle opening 117 corresponding to a groove 102*a*, a positive driving voltage is applied to electrodes 105*a* and 105*b* in the groove 102*a* and, at the same time, opposing electrodes 105*c* and 105*d* to the respective electrodes are grounded. Consequently, a driving electric field in the direction toward the groove 102*a* acts on sidewalls 103*a* and 103*b* and, if the driving electric field is perpendicular to a direction of polarization of the piezoelectric ceramic plate 101, the sidewalls 103*a* and 103*b* are deformed in the direction of the groove 102*a* by a piezoelectric thickness slip effect and the capacity inside the groove 102*a* decreases to increase pressure, whereby the ink is discharged from the nozzle opening 117.

In such a head chip, sound pressure is repeatedly reflected and takes a long time to completely attenuate because a degree of sealing a groove is low, although time to be consumed since vibration of sidewalls due to ink discharge is stopped until pressure of ink inside a groove declines to zero to enable discharge of the next ink depends on a length of a groove, a form of a nozzle opening, and the like. Thus, there is a problem in that it is difficult to achieve high speed consecutive discharge, that is, to achieve high speed printing.

In addition, particularly, since time to be consumed until sound pressure attenuates fluctuates significantly due to a form of a nozzle opening, there is a problem in that it is very difficult to control a discharge amount according to the form of a nozzle opening.

Moreover, a chamber consists of a boundary portion communicating with a common ink chamber and a pump portion from a nozzle opening to the boundary portion which is driven for discharging ink, and converging time during which pressure in the chamber attenuates is determined depending on a length of the pump portion, that is, a distance from the nozzle opening to the boundary portion. Thus, there is a problem in that, if the length of the pump is shortened in order to reduce converging time, the ink discharge property is deteriorated and printing is not performed normally.

SUMMARY OF THE INVENTION

In view of such circumstances, it is an object of the present invention to provide a head chip which reduces converging time, during which pressure in a chamber attenuates, to achieve high speed printing without deteriorating the ink discharge property and, at the same time, does not cause converging time to fluctuate even if a discharge amount is controlled according to a shape of a nozzle opening.

According to a first aspect of the present invention for solving the above-mentioned object, there is provided a head chip comprising: chambers defined on a substrate, having one-end portions in a longitudinal direction thereof, which communicate with nozzle openings; and electrodes provided on sidewalls of the chambers, in which a driving voltage is applied to the electrodes so that a capacity within the chambers is changed to discharge ink filled in the inside from the nozzle openings, characterized in that: an ink chamber plate defining a common ink chamber communicating with the chambers is joined on the substrate; the common ink chamber is provided with a partitioning portion for partitioning the chambers and the common ink chamber; and that communicating holes defining a pump length according to a distance from the nozzle openings are provided in the partitioning portion.

According to a second aspect of the present invention, in the first aspect of the invention, a head chip is characterized in that a plurality of the communicating holes are provided at an interval equivalent to the pump length.

According to a third aspect of the present invention, in the first or second aspect of the invention, a head chip is characterized in that the partitioning portion is formed of a separate member.

According to a fourth aspect of the present invention, in any one of the first to third aspects of the invention, a head chip is characterized in that the substrate is formed of a piezoelectric ceramic plate, and the chamber is defined by forming grooves in the piezoelectric ceramic plate and, at the same time, communicates with the common ink chamber at openings on the opposite side of the substrate at one end portion in the longitudinal direction of the chamber.

According to a fifth aspect of the present invention, in any one of the first to third aspects of the invention, a head chip is characterized in that the sidewalls made of piezoelectric ceramic are arranged on the substrate at a predetermined interval to define the chambers between the sidewalls and, at the same time, the common ink chamber is defined on the substrate, and the chambers and the common ink chamber communicate with each other at one end in the longitudinal direction of the chambers.

In the present invention described above, a communicating hole for defining a length of a pump of a chamber is provided, whereby converging time during which pressure in a chamber attenuates can be reduced without deteriorating the ink supply property and the ink discharge property, and high speed printing can be achieved by consecutively discharging ink at a high speed.

BRIEF DESCRIPTION OF THE DRAWINGS

For a more better understanding of the present invention, reference is made of a detailed description to be read in conjunction with the accompanying drawings, in which:

FIG. 10 is a sectional view in the longitudinal direction of chambers of head chips in accordance Embodiment 1 of the present invention and Comparative Example 1;

DETAILED DESCRIPTION OF THE PREFERRED EMBODIMENT

The present invention will be hereinafter described in detail based on an embodiment mode of the present invention.

Figure 1:
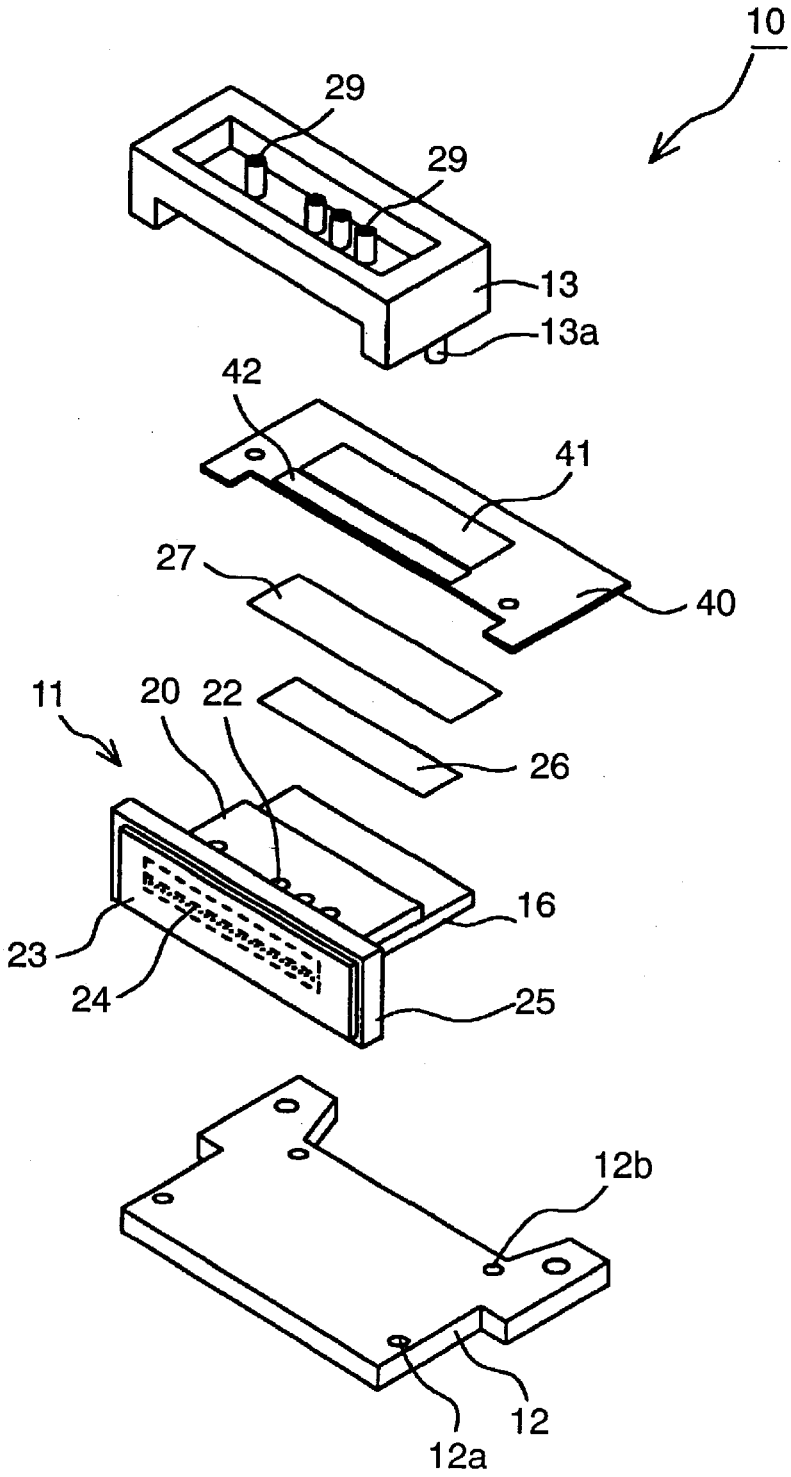
FIG. 1 is an exploded perspective view of an ink jet head in accordance with an embodiment mode of the present invention.
Figure 2A:
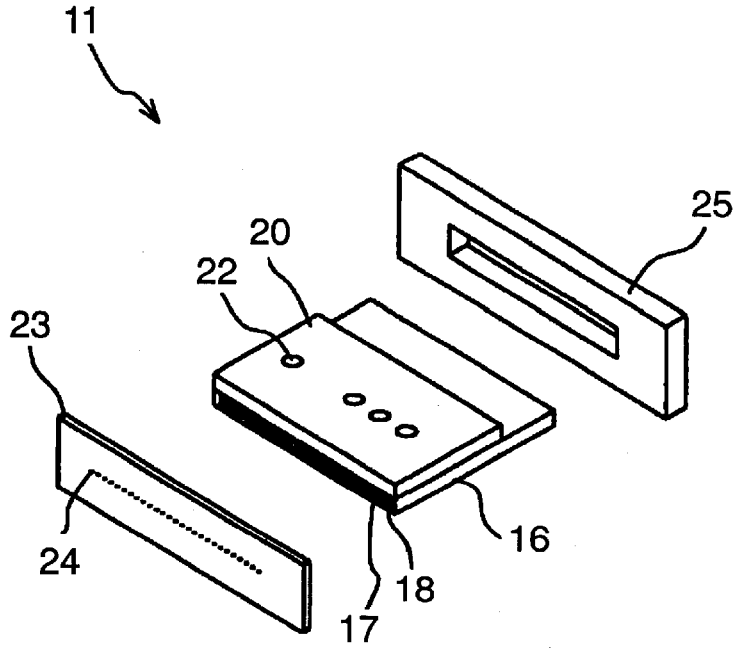
FIG. 2 is an exploded perspective view of a head chip in accordance with the embodiment mode of the present invention.
Figure 2B:
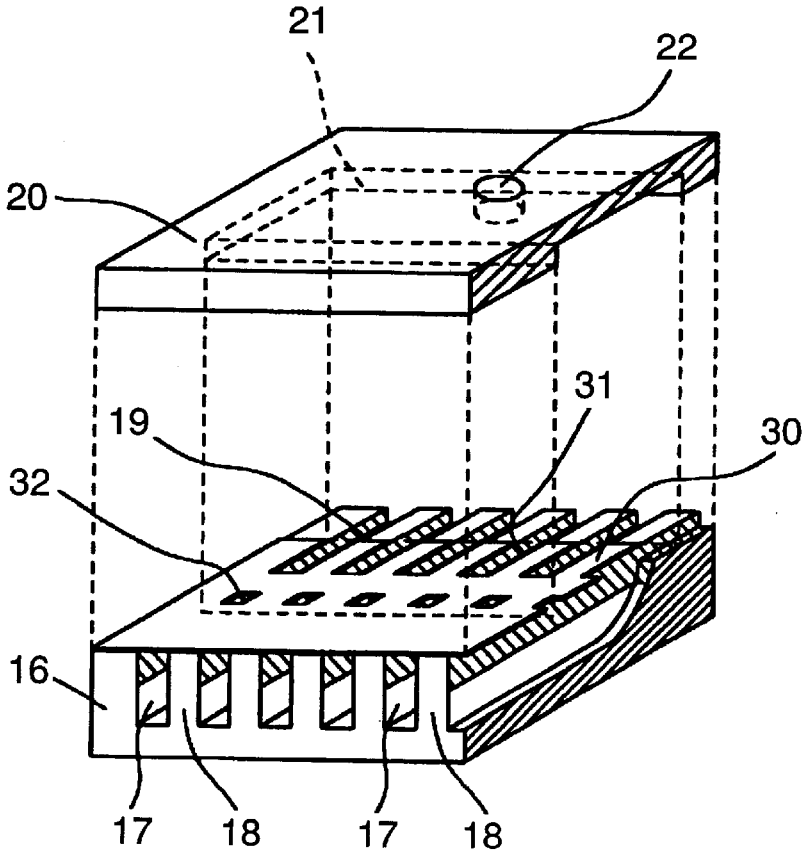
Figure 3A:
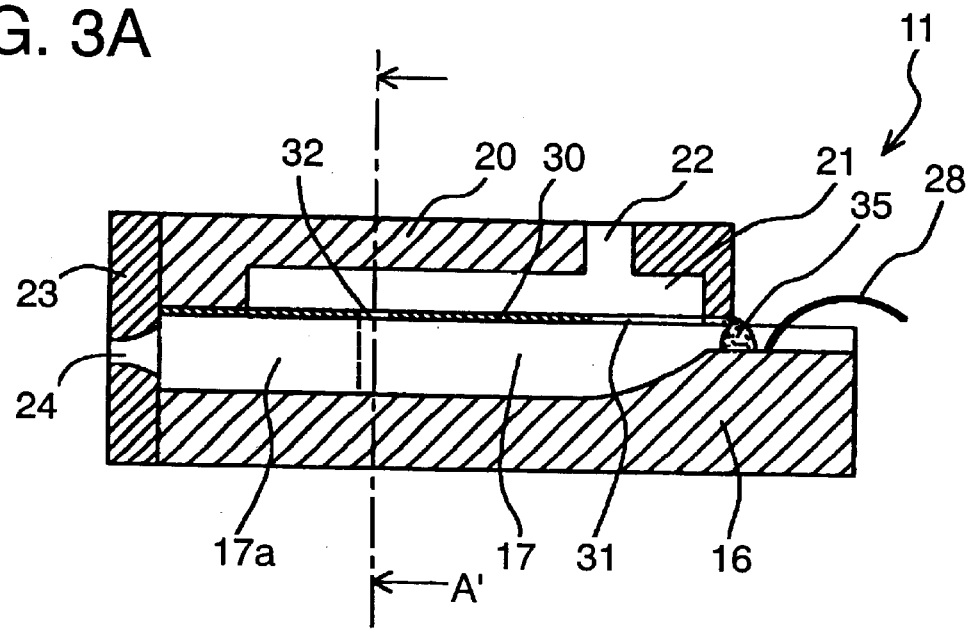
FIG. 3 is a sectional view of the head chip in accordance with the embodiment mode of the present invention, where (a) is a sectional view in the longitudinal direction of a chamber and (b) is an A—A' sectional view cut along A—A' of (a)
Figure 3B:
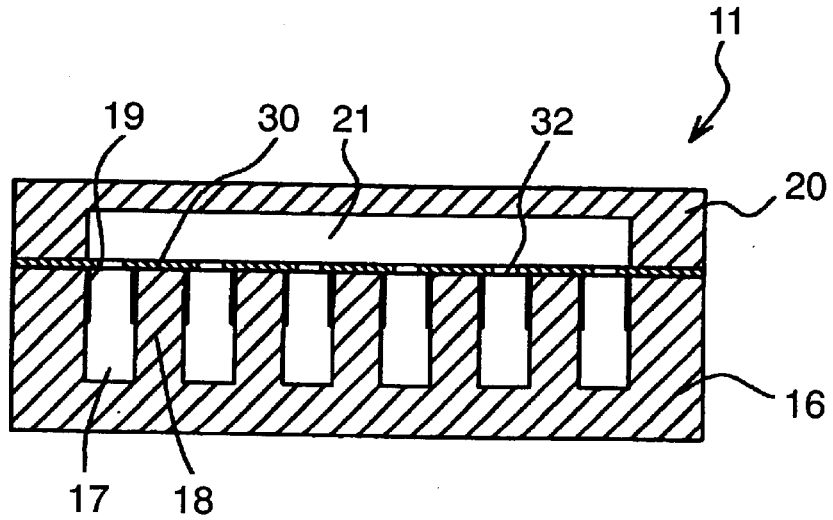
Figure 4A:
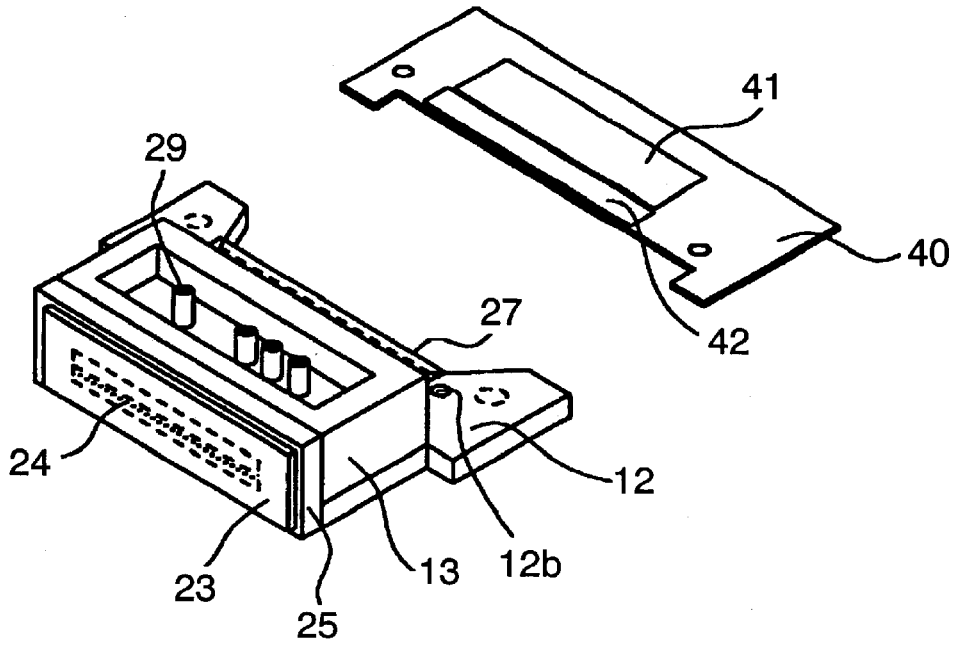
FIG. 4 is. a perspective view showing an assembly process of the ink jet head in accordance with the embodiment mode of the present invention.
Figure 4B:
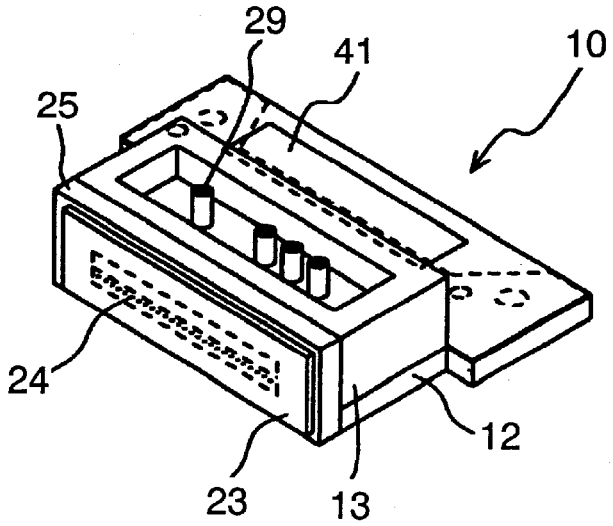

FIG. 1 is an exploded perspective view of an ink jet head in accordance with an embodiment mode, FIG. 2 is an exploded perspective view of a head chip, FIG. 3(*a*) is a sectional view in the longitudinal direction of a chamber of the head chip, FIG. 3(*b*) is a sectional view cut along a line A—A' of FIG. 3(*a*), and FIG. 4 is a schematic perspective view showing an assembly process of the ink jet head.

As shown in FIG. 1, an ink jet head 10 of this embodiment mode includes a head chip 11, a base plate 12 provided on one surface side of this head chip 11, a head cover 13 provided on the other surface side of the head chip 11 and a wiring substrate 40 mounted with a driving circuit 41 for driving the head chip 11.

First, the head chip 11 will be described in detail. As shown in FIGS. 2 and 3, chambers 17 consisting of a plurality of grooves are provided in parallel with each other in a piezoelectric ceramic plate 16 constituting the head chip 11, and each chamber 17 is separated by sidewalls 18. One end portion in the longitudinal direction of each chamber 17 is extended to one end surface of the piezoelectric ceramic plate 16 and the other end portion does not extend to the other end surface, making the groove to be gradually shallow. In addition, electrodes 19 for applying a driving electric field are formed on surfaces on opening side of both the sidewalls 18 in each chamber 17 throughout its longitudinal direction.

Here, each chamber 17 formed on the piezoelectric ceramic plate 16 is formed by, for example, a dice cutter of a disk shape, and the portion where the groove is made to be gradually shallow is formed according to a shape of the dice cutter. In addition, the electrodes 19 formed in each chamber 17 are formed by, for example, publicly-known evaporation from a diagonal direction.

An ink chamber plate 20 is joined to the opening side of the chamber 17 of the piezoelectric ceramic plate 16 via adhesive 35. This ink chamber plate 20 includes a common ink chamber 21 to be a recessed portion communicating with each chamber 17 and an ink supply port 22 that is bored from the bottom portion of this common ink chamber 21 in the direction opposite to the chamber 17.

Note that, in this embodiment mode, each chamber 17 is classified into a group corresponding to ink of each color of black (B), yellow (Y), magenta (M) and cyan (C), and four common ink chambers 21 and four ink supply ports 22 are provided, respectively.

In addition, although the ink chamber plate 20 can be formed of a ceramic plate, a metal plate or the like, it is preferable to use a ceramic plate having a close coefficient of thermal expansion when deformation or the like after joining with the piezoelectric ceramic plate 16 is taken into account.

A partitioning portion 30 consisting of a plate-like member, in which ink supply communicating holes 31 for making the chambers 17 and the common ink chamber 21 to communicate with each other are provided through in the thickness direction, is provided between such piezoelectric ceramic plate 16 and ink chamber plate 20.

The ink supply communicating holes 31 of the partitioning portion 30 are provided in positions opposing the end portions where the chambers 17 are made shallow and prevent bubbles in the chambers 17 from remaining in the end portions.

In addition, communicating holes 32 for making the chambers 17 and the common ink chamber 21 to communicate with each other to define a pump length of the chambers 17 are provided between the ink supply communicating holes 31 and one ends of the chambers 17 communicating with the nozzle openings 24.

Here, a pump length of a chamber means in general a length of a pump portion, assuming that the pump portion is an area from a boundary portion to a nozzle opening in the case where an area of a chamber communicating with a common ink chamber is assumed to be the boundary portion. Convergence time during which pressure, which is generated by sound pressure in the chamber being repeatedly reflected since vibration on sidewalls stops after ink is discharged, attenuates is determined according to such a length of a pump portion (pump length).

Thus, in this embodiment mode, the communicating holes 32 are provided in the partitioning portion 30, whereby, assuming that a pump portion 17*a* is from the communicating hole 32 to the nozzle opening 24, the length of the pump portion 17*a* can be regarded as a pump length. Consequently, the length of the pump portion 17*a* can be easily defined by the position of the communicating hole 32 and convergence time can be reduced.

Further, the number of such communicating holes 32 is not specifically limited. For example, a plurality of communicating holes 32 may be provided.

In addition, for example, ink may be supplied from the common ink chamber 21 to the chambers 17 by a plurality of communicating holes 32 without providing the ink supply communicating holes 31, or a plurality of communicating holes 32 may be provided together with the ink supply communicating holes 31.

In providing a plurality of communicating holes 32 in this way, it is preferable to provide them at an equal interval with a pump length of the pump portion 17*a* defined by the communicating hole 32 on the nozzle opening 24 side as a reference.

Moreover, in this embodiment mode, the partitioning portion 30 is formed of a member that is not integral with the ink chamber plate 20 and nipped by the piezoelectric ceramic plate 16 and the ink chamber plate 20. However, the partitioning portion 30 is not limited to this and may be integrally formed on the piezoelectric ceramic plate 16 side of the ink chamber plate 20. A method of forming such an ink chamber plate is not specifically limited. For example, the ink chamber plate may be formed by etching a ceramic plate or may be formed by machining a metal plate.

In addition, the nozzle plate 23 is joined to the end surface of the joined body of the piezoelectric ceramic plate 16 and the ink chamber plate 20 in which the chambers 17 are opened, and the nozzle openings 24 are formed in positions opposing the respective chambers 17 of the nozzle plate 23.

In this embodiment mode, the nozzle plate 23 has a larger area than the end surface of the joined body of the piezoelectric ceramic plate 16 and the ink chamber plate 20 in which the chambers 17 are opened. This nozzle plate 23 is a polyimide film or the like in which the nozzle openings 24 are formed using, for example, an excimer laser apparatus. In addition, although not shown in the figure, a repellent film having repellency is provided on the surface of the nozzle plate 23 opposing an object to be printed in order to prevent adhesion of ink or the like.

Further, in this embodiment mode, a nozzle support plate 25 is disposed around the end portion of the joined body of the piezoelectric ceramic plate 16 and the ink chamber plate 20 in which the chambers 17 are opened. This nozzle support plate 25 is joined to the external perimeter of the end surface of the joined body on the nozzle plate 23 to securely hold the nozzle plate 23. Naturally, this nozzle support plate 25 may not be provided.

First, the piezoelectric ceramic plate 16 and the ink chamber plate 20 are joined such that the partitioning portion 30 is nipped between them, and the nozzle plate 23 is jointed to the end surface of the joined body. Then, the nozzle support plate 25 is fit and adhered to the external perimeter surface of the nozzle plate 23 and the joined body of the piezoelectric ceramic plate 16 and the ink chamber plate 20, whereby the head chip 11 of such a configuration is formed.

In addition, the ink jet head 10 of this embodiment mode using such a head chip 11 will be hereinafter described.

As shown in FIGS. 1 and 4, the ink jet head 10 of this embodiment mode has a not-shown wiring pattern, which is connected to the electrodes 19 via the bonding wire 28 or the like, formed at the end portion on the opposite side of the nozzle openings 24 side of the piezoelectric ceramic plate 16 constituting the head chip 11. A flexible cable 27 is joined to this wiring pattern via an anisotropic conductive film 26. In addition, the aluminum base plate 12 on the piezoelectric ceramic plate 16 side and the head cover 13 on the ink chamber plate 20 side are assembled to the rear end side of the nozzle support plate 25 of the joined body of the piezoelectric ceramic plate 16 and the ink chamber plate 20. The base plate 12 and the head cover 13 are fixed by engaging locking shafts 13*a* of the head cover 13 in locking holes 12*a* of the base plate 12 and nip the joined body of the piezoelectric ceramic plate 16 and the ink chamber plate 20. Ink introducing paths 29 for communicating to the respective ink supply ports 22 of the ink chamber plate 20 are provided in the head cover 13.

In addition, as shown in FIG. 4(*a*), the wiring substrate 40 is fixed on the base plate 12 protruding to the rear end side of the piezoelectric ceramic plate 16. Here, the driving circuit 41 such as an integrated circuit for driving the head chip 11 is mounted on the wiring substrate 40, and the driving circuit 41 and the flexible cable 27 are connected via the anisotropic conductive film 42. Consequently, the ink jet head 10 of FIG. 4(*b*) is completed.

In such an ink jet head 10, each chamber 17 is filled with ink from the ink supply port 22 via the ink introducing path 29 and a predetermined driving electric field is acted on the sidewalls 18 on both sides of the predetermined chamber 17 by the driving circuit 41 via the electrodes 19, whereby the sidewalls 18 are deformed to change the capacity inside the predetermined chamber 17 and the ink in the chamber 17 is discharged from the nozzle openings 24.

In addition, a head unit 50 is formed in such an ink jet head 10 while being assembled with a tank holder 51 for holding a not-shown ink cartridge.

Figure 5A:
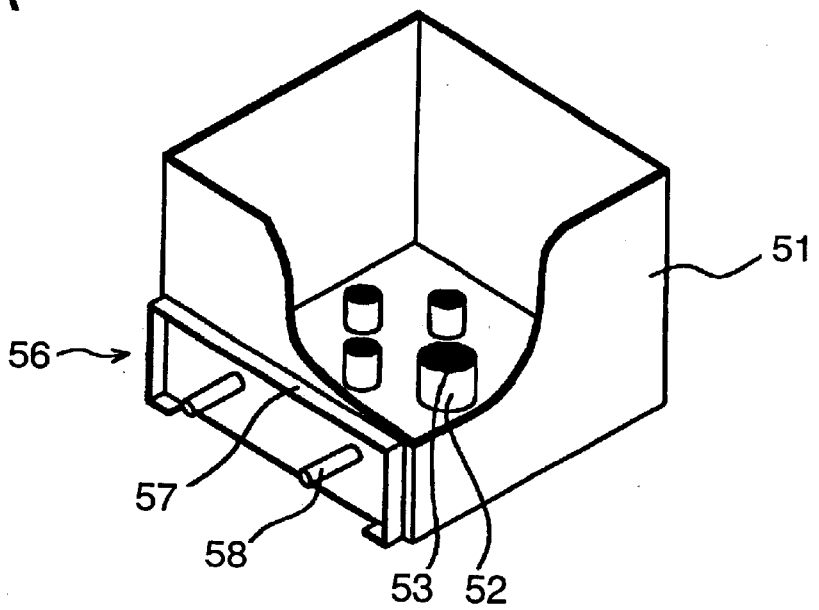
FIG. 5 is a disassembled perspective view schematically showing a head unit in accordance with the embodiment mode of the present invention.
Figure 5B:
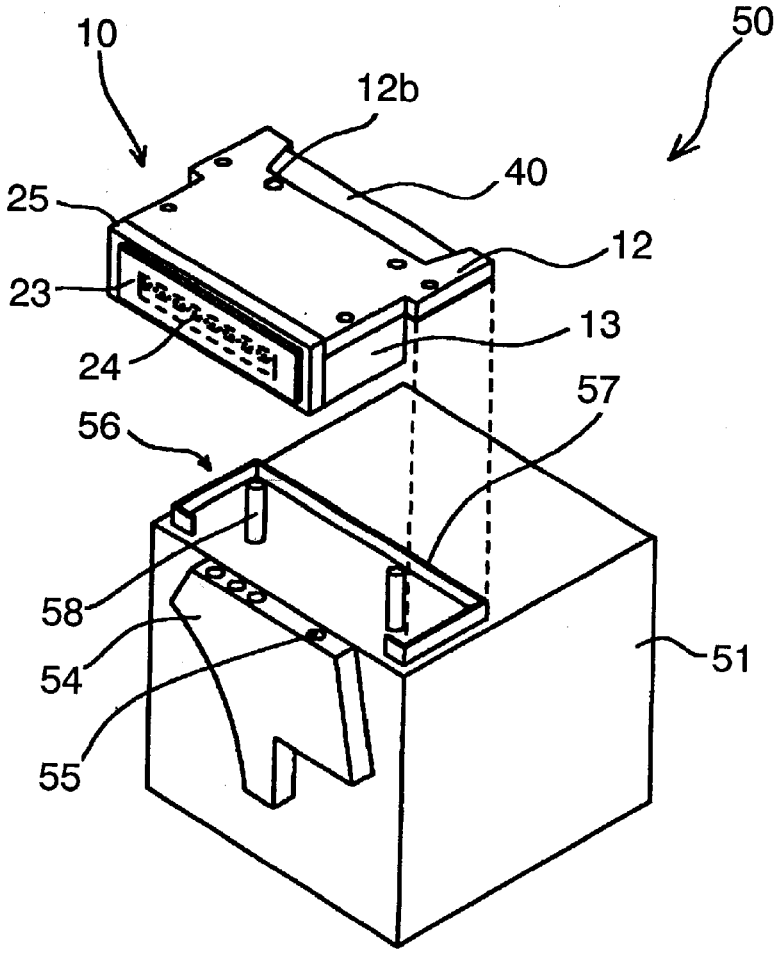

An example of this tank holder 51 is shown in FIG. 5. The tank holder 51 shown in FIG. 5 is formed in substantially a box shape with one surface opened and is capable of detachably holding an ink cartridge. In addition, the tank holder 51 is provided with, on the upper surface of its bottom wall, coupling portions 52 to be coupled to the ink supply ports 22 that are opening portions formed in the bottom portion of the ink cartridge. The coupling portions 52 are provided for ink of respective colors, for example, black (B), yellow (Y), magenta (M) and cyan (C). Not-shown ink flow paths are formed in the coupling portions 52, and filters 53 are provided at the top ends of the coupling portions 52 to be their openings. In addition, the ink flow paths formed in the coupling portions 52 are formed communicating to the back surface side of the bottom wall, and each ink flow path communicates to a head coupling port 55 opened in a sidewall of a flowpath substrate 54 via a not-shown ink flow path inside the flow path substrate 54 provided on the back surface side of the tank holder 51. This head coupling port 55 is opened on the side surface side of the tank holder 51, and a head holding portion 56 for holding the above-mentioned ink jet head 10 is provided in the bottom portion of the side wall. The head holding portion 56 is vertically provided with a surrounding wall 57 that is vertically provided in substantially a reverse letter U shape surrounding the driving circuit 41 provided on the wiring substrate 40 and engaging shafts 58 that are within the surrounding wall 57 and engage with the engaging holes 12*b* provided in the base plate 12 and in the wiring substrate 40 of the ink jet head 10.

Therefore, the ink jet head 10 is mounted on this head holding portion 56 to complete the head unit 50. At this point, the ink introducing paths 29 formed in the head cover 13 are coupled to the head coupling ports 55 of the flow path substrate 54. Consequently, the ink introduced from the ink cartridge via the coupling portions 52 of the tank holder 51 is introduced into the ink introducing paths 29 of the ink jet head 10 through the ink flow path inside the flow path substrate 54, and the common ink chamber 21 and the chambers 17 are filled with the ink through the ink supply communicating holes 31 and the communicating holes 32.

The head unit 50 formed in this way is, for example, mounted on a carriage of an ink jet recording device and used. An example of this usage form is schematically shown in FIG. 6.

Figure 6:
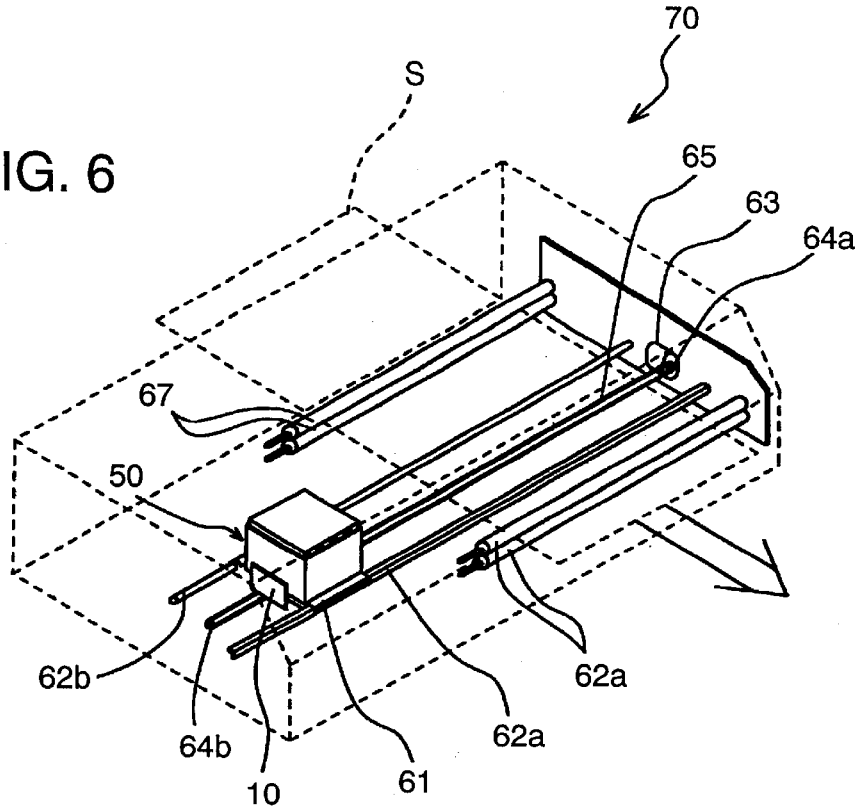
FIG. 6 is a schematic perspective view of an ink jet recording device in accordance with the embodiment mode of the present invention.

As shown in FIG. 6, a carriage 61 of an ink jet recording device 70 is mounted movably in the axial direction on a pair of guide rails 62*a* and 62*b* and carried via a timing belt 65 that is extended between a pulley 64*a* provided in one end side of the guide rails 62 and coupled to a carriage driving motor 63 and a pulley 64*b* provided on the other end side. A pair of conveying rollers 66 and 67 are provided a long the guide rails 62*a* and 62*b*, respectively, on both sides in the direction perpendicular to the conveying direction of the carriage 61. These conveying rollers 66 and 67 carry a medium to be recorded S below the carriage 61 in the direction perpendicular to the conveying direction of the carriage 61.

The above-mentioned head unit 50 is mounted on the carriage 61, and an ink cartridge is held detachably attachable to this head unit 50.

According to such an ink jet recording device 70, the carriage 61 is scanned in the direction perpendicular to a feeding direction of the medium to be recorded S while feeding it, whereby characters and images can be recorded on the medium to be recorded S by the ink jet head 10.

Figure 7:
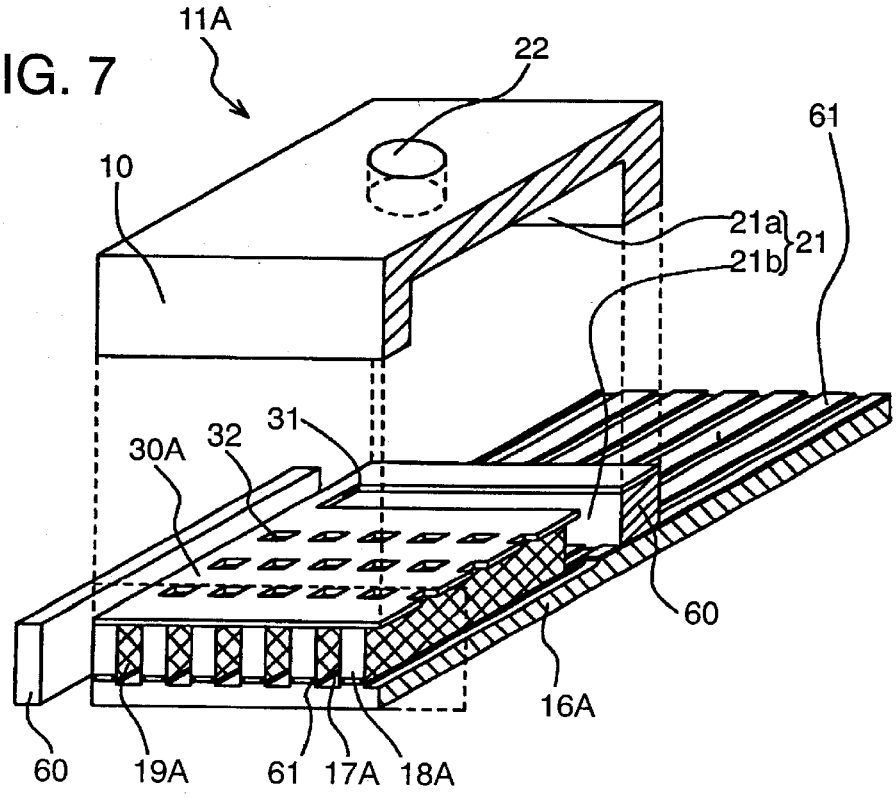
FIG. 7 is a disassembled perspective view showing another example of the head chip in accordance with the embodiment mode of the present invention.
Figure 8A:
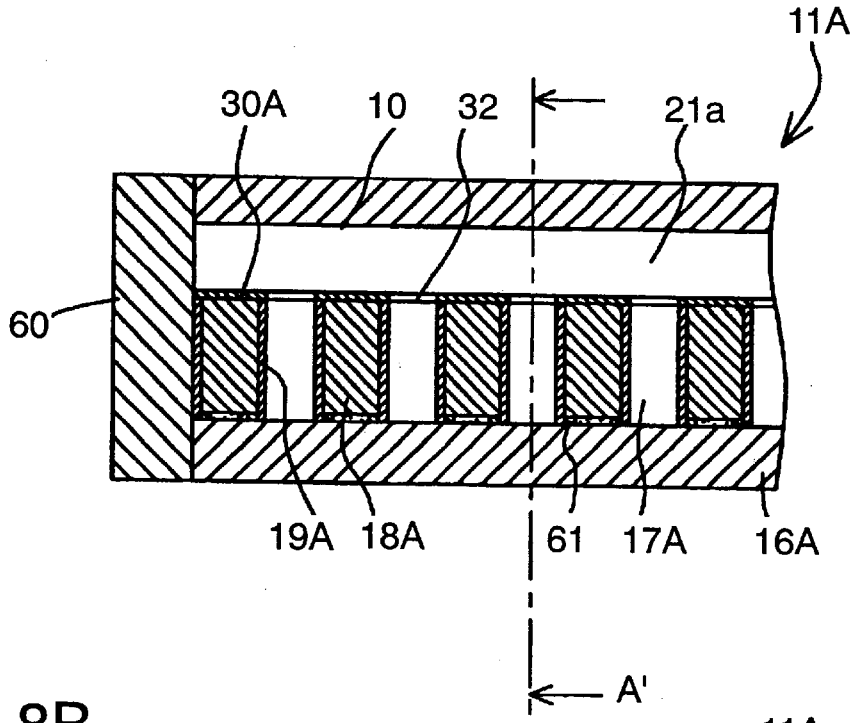
FIG. 8 is a sectional view of the head chip in accordance with the embodiment mode of the present invention, where (a) is a sectional view in the direction in which chambers are disposed in parallel and (b) is a sectional view cut along A—A' of (a)
Figure 8B:
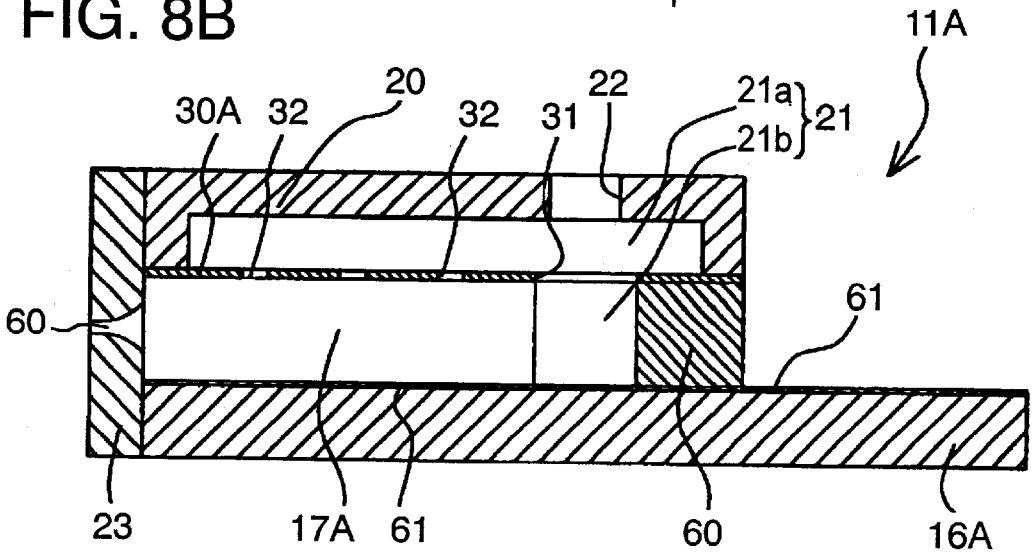

Further, although the head chip 11 is a head chip in which the chambers 17 consisting of grooves are defined in the piezoelectric ceramic plate 16, the head chip 11 is not limited to this. For example, sidewalls made of piezoelectric ceramic may be arranged at a predetermined interval on a substrate. Such an example is shown in FIGS. 7 and 8. Incidentally, FIG. 7 is an exploded perspective view showing another example of a head chip, FIG. 8(*a*) is a sectional view cut in the direction in which chambers of the head chip are disposed in parallel and FIG. 8(*b*) is a sectional view cut along the line A—A' of FIG. 8(*a*).

As illustrated, in a head chip 11A, sidewalls 18A made of piezoelectric ceramic are arranged at a predetermined interval on a substrate 16A, and chambers 17A are defined between the sidewalls 18A.

In addition, a plurality of sealing plates 60 are provided on the substrate 16A, and a second ink chamber 21*b*, which communicates with one ends in the longitudinal direction of the chambers 17A and, at the same time, communicates with a first ink chamber 21*a* formed in the ink chamber plate 20 to constitute a part of the common ink chamber 21, is defined by these sealing plates 60.

In addition, in a partitioning portion 30A, an ink supply communicating hole 31 is provided in a position opposing the second ink chamber 21*b* and a plurality of communicating holes 32 are provided at a predetermined interval between the chambers 17A and the first ink chamber 21*a*.

Moreover, electrodes 19A provided on both the sidewalls 18A of the chambers 17A are provided over the entire surface of the sidewalls 18A, and communication between the electrodes 19A and the driving circuit 41 is connected by the wiring 61. For example, the wiring 61 is extended along the chambers 17A defined on both sides between the substrate 16A and the sidewalls 18A and surely contacts the electrodes 19A on both end portions in the width direction of the extended wiring 61, whereby the communication between the electrodes 19A and the wiring 61 is realized.

Even such a head chip 11A can reduce converging time during which pressure inside the chambers 17A attenuates and, at the same time, improve the ink supply property and the ink discharge property by providing the communicating holes 32 for determining a pump length of the chambers 17A in the partitioning portion 30A.

In addition, although a head chip using insulating ink is described as an example in the above-mentioned embodiment mode, a head chip using conductive ink such as water ink may be employed.

If conductive ink such as water ink is used in a head chip in this way, since electrodes are subjected to conduction by the ink in the chambers 17, electrolysis of the ink is caused and, at the same time, normal driving cannot be carried out. Thus, a chamber for discharging ink to a piezoelectric ceramic plate and a dummy chamber that is not filled with ink are alternately arranged to have the conductive ink discharged. However,the dummy chamber may be prevented from being filled with ink by a partitioning portion.

Figure 9A:
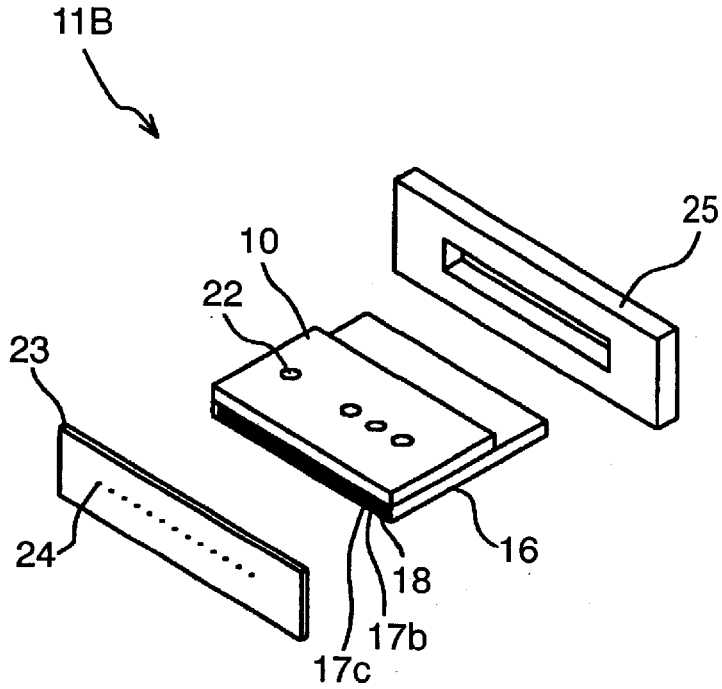
FIG. 9 is a disassembled perspective view showing another example of the head chip in accordance with the embodiment mode of the present invention.
Figure 9B:
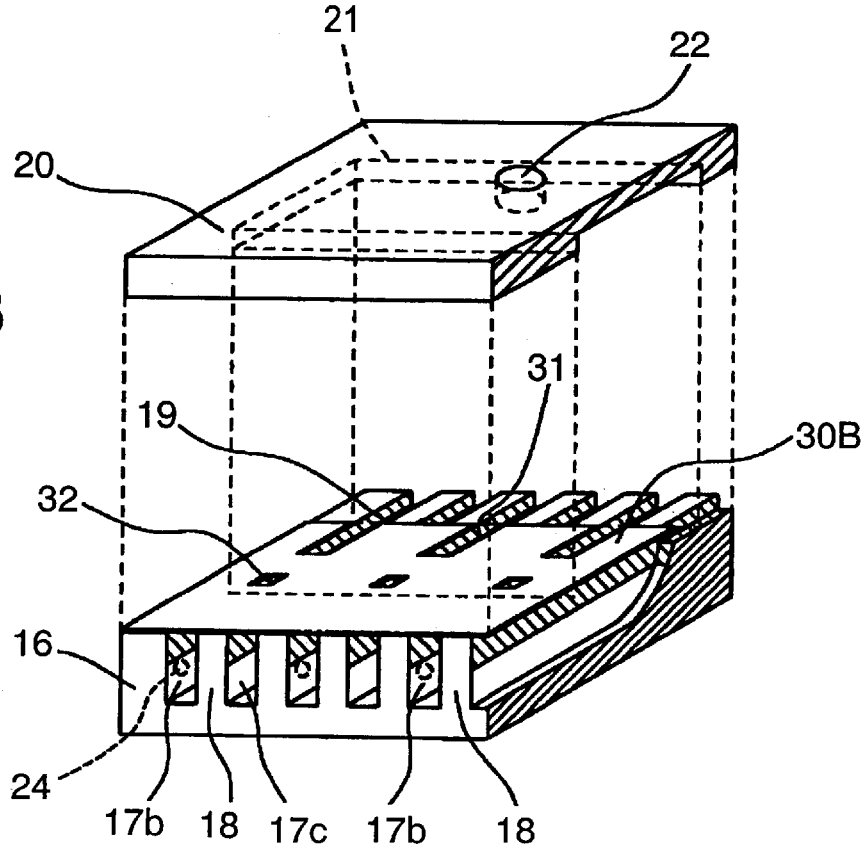

Such an example is shown in figures. Incidentally, FIG. 9 is an exploded perspective view showing another example of the head chip of the present invention.

As illustrated, chambers 17*b* and dummy chambers 17*c* are alternately arranged on the piezoelectric ceramic plate 16 of a head chip 11B, and the nozzle openings 24 are provided only in areas opposing the chambers 17*b* of the nozzle plate 23.

The ink supply communicating holes 31 and the communicating holes 32 are provided in positions opposing the chambers 17*b* in a partitioning portion 30B nipped between the piezoelectric ceramic plate 16 and the ink chamber plate 20 of such a head chip 11B. Areas opposing the dummy chambers 17*c* are sealed by the partitioning portion 30B to prevent the dummy chambers 17*c* from being filled with ink.

Even the head chip 11B using conductive ink in this way can reduce converging time during which pressure in the chambers 17*b* attenuates and, at the same time, improve the ink supply property and the ink discharge property by providing the communicating holes 32 for determining a pump length of the chambers 17*b* in the partitioning portion 30B.

Further, if conductive ink is used for the head chip 11A, the partitioning portion 30B of the above-mentioned head chip 11B cannot prevent the ink from not being supplied into all the chambers 17A due to a second ink chamber 21*b*. Consequently, if conductive ink is used in the head chip 11A, it is necessary to cause the sealing plates 60 to abut the end portions of the sidewalls 18A to eliminate the second ink chamber 21*b* and, at the same time, provide the partitioning portion 30B or change a shape of a partitioning portion to provide dummy chambers that are not filled with ink.

In addition, although the ink chamber plate 20 and the partitioning portions 30A or 30B are separate members in the head chips 11A or 11B, the ink chamber plate 20 and the partitioning portions 30A or 30B are not limited to this and may be formed integrally.

Embodiment 1

FIG. 10(*a*) is a sectional view in the longitudinal direction of a chamber of a head chip of Embodiment 1.

As illustrated, there are four head chips 11 of Embodiment 1 in which positions of communicating holes of a partitioning portion 30 from nozzle openings 24 are different from each other.

There are four head chips 11 in which a length in the longitudinal direction of a chamber is 7.2 mm, a size of a communicating hole is 60 um×180 um and distances from nozzle openings of the communicating holes 32 are 1.8 mm, 3.6 mm, 5.4 mm and 7.2 mm, respectively.

Comparative Example 1

FIG. 10(*b*) is a sectional view in the longitudinal direction of a chamber of a head chip in accordance with Comparative Example 1.

As illustrated, a head chip 11C of Comparative Example 1 is a conventional head chip in which a common ink chamber 21 and a chamber 17 directly communicate with each other without providing the partitioning portion 30.

There are four head chips 11C in which, in this communication between the common ink chamber 21 and the chamber 17, the common ink chamber 21 is formed such that the common ink chamber 21 opens from a position equivalent to the communicating hole 32 of the head chip 11 to the end portion where the chamber 17 is shallow correspondence with four head chips 11 with different positions of the communicating holes 32 of Embodiment 1.

There are such four head chips 11C in which the length in the longitudinal direction of the chamber 17 is 7.2 mm, a pump length of the chamber 17 is 1.8 mm, 3.2 mm, 5.4 mm and 7.2 mm, respectively.

Experimental Example 1

AP was measured for each of the four head chips 11 of Embodiment 1 and the four head chips 11C of Comparative Example 1. A result of the measurement is shown in Table 1. Further, as a measuring method, pressure was measured at the entrances of the nozzle openings 24.

TABLE 1

| Position of communicating hole or pump length (mm) | 1.8 | 3.6 | 5.4 | 7.2 |
|---|---|---|---|---|
| AP of Embodiment 1 (× usec) | 3.80 | 6.80 | 10.0 | 12.8 |
| AP of Comparative Example 1 (× usec) | 3.54 | 6.59 | 9.64 | 12.7 |

As shown in Table 1, it was found that AP was substantially equal in the head chips 11 of Embodiment 1 having the partitioning portion 30 and the conventional head chips 11C of Comparative Example 1. That is, it was found that the distance from the nozzle opening 24 of the communicating hole 32 is the pump length in the head chips 11.

Consequently, the pump length can be easily determined according to the position of the communicating hole 32.

Further, if the opening where the common ink chamber 21 and the chamber 17 communicate with each other is widened or narrowed as in the conventional head chips 11C of Comparative Example 1, a flow path resistance of an area where the common ink chamber 21 and the chamber 17 communicate with each other changes. As a result, converging time during which pressure in the chamber 17 is reduced increases and the ink supply property and the ink discharge property are deteriorated.

Consequently, as in the head chips 11 of Embodiment 1, the ink supply property and the ink discharge property can be improved and, at the same time, converging time during which pressure in the chamber 17 attenuates can be reduced by providing the partitioning portion 30 having the communicating holes 32 capable of defining a pump length.

Embodiments 2 to 4

Embodiments 2 to 4 are examples in which a chamber length is 7.2 mm and a plurality of communicating holes are provided in a partitioning portion. In each head chip of Embodiments 2 to 4, there are provided two to four communicating holes.

Figure 11:
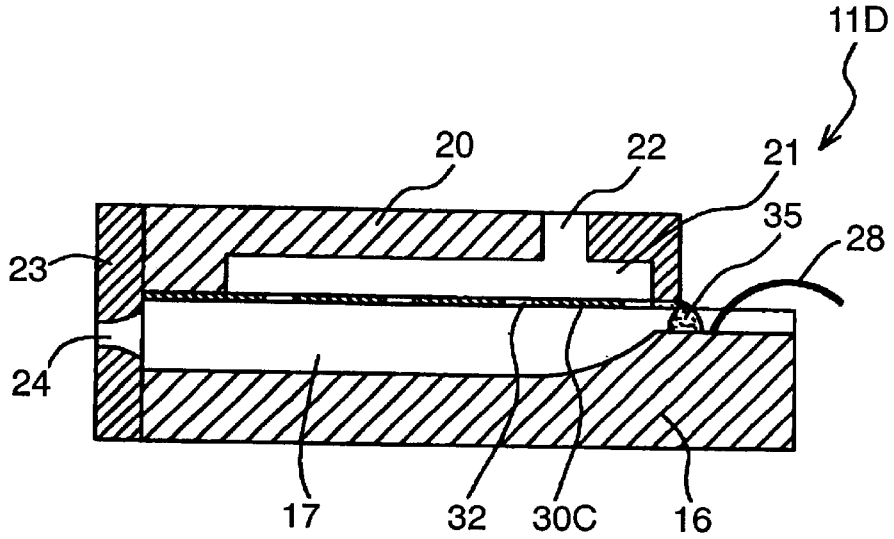
FIG. 11 is a sectional view in the longitudinal direction of a chamber of a head chip in accordance with Embodiment 4 of the present invention.
Figure 12:
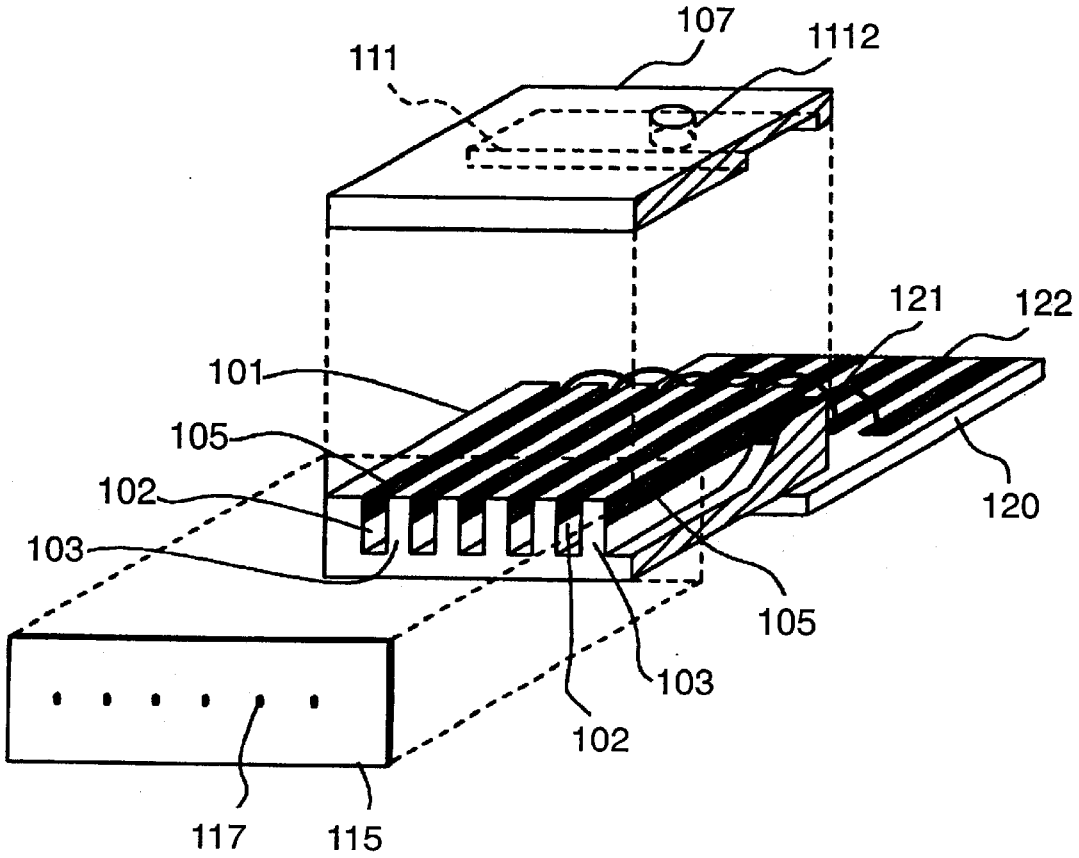
FIG. 12 PRIOR ART
FIG. 12 is a disassembled perspective view schematically showing a head chip in accordance with the prior art.
Figure 13A:
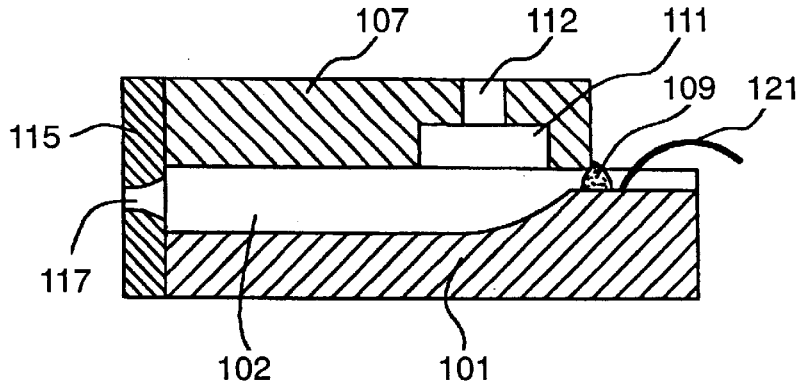
FIG. 13A PRIOR ART
FIG. 13 is a sectional view schematically showing the head chip in accordance with the prior art.
Figure 13B:
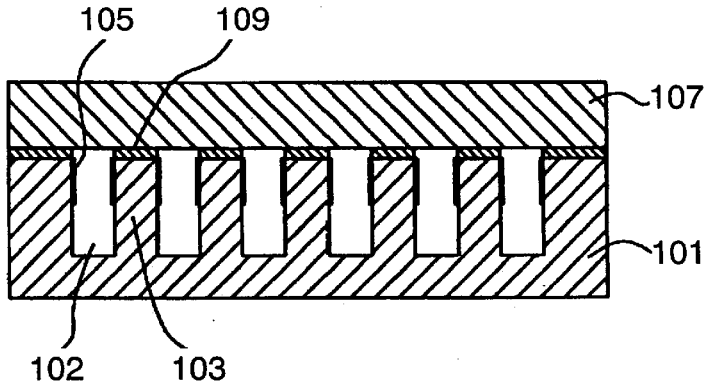
FIG. 13B PRIOR ART
Figure 14:
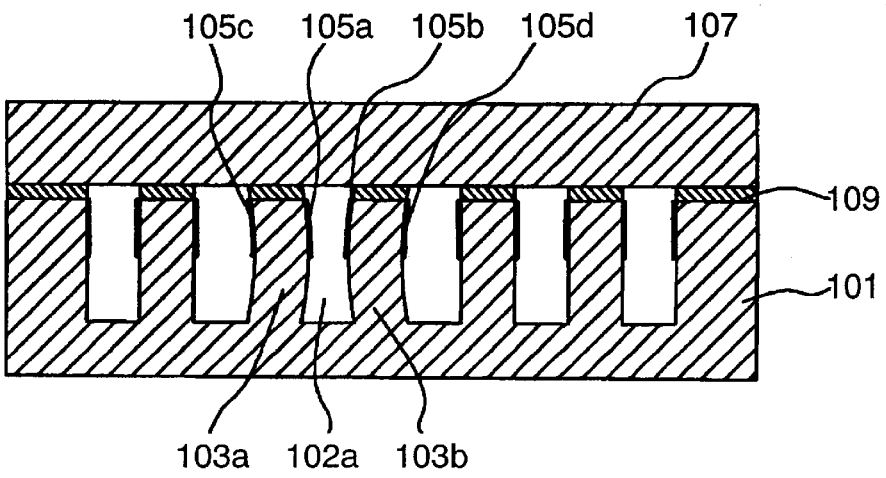
FIG. 14 PRIOR ART
FIG. 14 is a sectional view schematically showing the head chip in accordance with the prior art.

Here, a head chip of Embodiment 4 is shown in FIG. 11. Incidentally, FIG. 11 is a sectional view in the longitudinal direction of a chamber.

As illustrated, in a head chip 11D of Embodiment 4, the length in the longitudinal direction of the chamber 17 is 7.2 mm and four communicating holes 32 are provided in a partitioning portion 30C at an interval of 1.8 mm.

Experimental Example 2

AP, converging time, minimum pressure and maximum pressure were measured for the head chip 11 of Embodiment 1 in which only one communicating hole 32 with the distance of 7.2 mm from the nozzle opening 24 of the communicating hole 32 is provided and the respective head chips of Embodiments 2 to 4. A result of the measurement is shown in Table 2 below. Further, in the experimental example 2, pressure at the entrance of the nozzle opening was measured as in the experimental example 1.

TABLE 2

| Number of communicating holes | Embodiment 1 (One) | Embodiment 2 (Two) | Embodiment 3 (Three) | Embodiment 4 (Four) |
|---|---|---|---|---|
| Interval of communicating holes (mm) | 7.2 | 3.6 | 2.4 | 1.8 |
| Converging time (× usec) | 27.4 | 20.8 | 15.8 | 13.3 |
| AP (× usec) | 13.0 | 6.33 | 4.82 | 3.60 |
| Minimum pressure (× $10^5$Pa) | −1.99 | −1.99 | −1.99 | −1.99 |
| Maximum pressure (× $10^4$Pa) | 9.03 | 6.02 | 3.94 | 3.34 |

It can be seen from the result shown in Table 2 that converging time is further reduced and dispersion of maximum pressures is smaller in the head chip provided with a plurality of communicating holes of each of Embodiments 2 to 4 compared with the head chip 11 provided with only one communicating hole 32 of Embodiment 1.

In addition, in the head chip provided with three or more communicating holes of each of Embodiments 3 and 4, since a difference of intervals of the communicating holes is smaller, converging time is not significantly reduced and tends to be stable. Consequently, if the length in the longitudinal direction of the chamber 17 is 7.2 mm, it is preferable to provide three or more communicating holes 32 as in Embodiments 3 and 4.

Embodiments 5 to 7

Embodiments 5 to 7 are examples in which a plurality of communicating holes are provided in each of head chips with different chamber lengths at the same interval as in Embodiment 4. Head chips of the Embodiments 5 to 7 are examples in which the chamber lengths are 5.4 mm, 9.0 mm and 10.8 mm, respectively, and three, five and six communicating holes are provided in the respective head chips.

Experimental Example 3

AP and converging time of the head chip 11C having the chamber length of 7.2 mm and provided with four communicating holes of Embodiment 4 and the head chips of Embodiments 5 to 7 are measured. A result of the measurement is shown in Table 3 below. Further, in the experimental example 3, pressure at the entrance of the nozzle opening is measured as in experimental example 1.

TABLE 3

| Number of communicating holes | Embodiment 5 (Three) | Embodiment 4 (Four) | Embodiment 6 (Five) | Embodiment 7 (Six) |
|---|---|---|---|---|
| Chamber length (mm) | 5.4 | 7.2 | 9.0 | 10.8 |
| Converging time (× usec) | 11.5 | 13.3 | 13.3 | 16.1 |
| AP (× usec) | 3.60 | 3.60 | 3.60 | 3.60 |

It can be seen from the result shown in Table 3 that, even if the chamber lengths are different as in Embodiments 4 to 7, converging time can be kept constant by providing a plurality of communicating holes 32 at an equal interval.

Embodiments 8 to 11

Embodiments 8 to 11 are examples in which a nozzle resistance of the above-mentioned head chip provided with four communicating holes of Embodiment 4 is changed. The respective head chips of Embodiments 8 to 11 are examples in which the chamber length is 7.2 mm, four communicating holes 32 are provided at an interval of 1.8 mm and nozzle resistances are 20%, 40%, 60% and 80%, respectively.

Comparative Examples 2 to 5

Comparative Examples 2 to 5 are examples in which a nozzle resistance of the conventional head chip is changed as in Embodiments 8 to 11 for comparison purpose. The respective head chips of Comparative Examples 2 to 5 are examples in which a nozzle resistances of the head chip 11C of the above-mentioned Comparative Example 1 having the pump length of 1.8 mm are 20%, 40%, 60% and 80%, respectively.

Experimental Example 4

Converging time of each head chip in Embodiments 8 to 11 and Comparative Examples 2 to 5 was measured. A result of the measurement is shown in Table 4 below.

TABLE 4

| | Nozzle resistance | 20% | 40% | 60% | 80% |
|---|---|---|---|---|---|
| Embodiments 8 to 11 | Converging time (× usec) | 13.3 | 13.3 | 16.1 | 16.2 |
| Comparative Examples 2 to 5 | | 10.3 | 11.7 | 17.6 | 24.8 |

Fluctuating widths of converging time between the head chips of Embodiments 8 to 11 and the head chips of Comparative Examples 2 to 5 found from the result shown in Table 4 are shown in Table 5.

TABLE 5

| | Time difference | Fluctuation ratio for nozzle resistance |
|---|---|---|
| Embodiments 8 to 11 | 2.90 usec | 1 |
| Comparative Examples 2 to 5 | 14.5 usec | 5 |

It can be seen from the result shown in Tables 4 and 5 that a fluctuating width of converging time due to a change in nozzle resistance is large at 14.5 μsec in the head chips of Comparative Examples 2 to 5 and is relatively small at 2.9 μsec in the head chips of Embodiments 8 to 11. If both the head chips are compared in a fluctuation ratio of converging time, the fluctuation ratio in the head chips of Embodiments 8 to 11 provided with a plurality of communicating holes 32 at an equal interval is one fifth of that in the conventional head chips of Comparative Examples 2 to 5.

In this way, although converging time is susceptible to fluctuation of a nozzle resistance in the conventional head chip as shown in Comparative Example 2, the head chips of Embodiments 8 to 11 provided with a plurality of communicating holes at an equal interval are unsusceptible to converging time due to fluctuation of a nozzle resistance and thus can steadily discharge ink.

As described above, in the present invention, communicating holes for defining a pump length according to a distance from a nozzle opening are provided in a partitioning portion of a common ink chamber, whereby converging time during which pressure in a chamber attenuates can be reduced and high speed consecutive discharge of ink, that is, high speed printing can be achieved. In addition, since time consumed until sound pressure attenuates does not depend on a shape of a nozzle opening, control of a discharge amount according to the shape of the nozzle opening can be attained under a fixed discharge condition.

What is claimed is:

1. A head chip comprising:

a substrate in which a plurality of individual ink chambers are formed for containing ink;

a nozzle opening in communication with one end of each individual ink chamber for discharging the ink contained within the individual ink chambers;

an electrode within each individual ink chamber for changing a volume within the respective individual ink chambers according to a driving voltage applied thereto to cause the ink in the respective individual ink chambers to be ejected through the nozzle opening;

an ink chamber plate forming a common ink chamber in communication with the respective individual ink chambers, the ink chamber plate being joined to the substrate; and a partitioning member for creating a partition between the individual ink chambers and the common ink chamber and having a plurality of communicating holes opening to each of the individual ink chambers including first communicating holes for defining a pump length of the respective individual ink chambers according to a distance of the first communicating holes from the respective nozzle openings.

2. A head chip according to claim 1; wherein the plurality of communicating holes are spaced apart by a distance equivalent to the pump length.

3. A head chip according to claim 2; wherein the substrate is formed of a piezoelectric ceramic plate, and the individual ink chambers comprise grooves formed in the piezoelectric ceramic plate to communicate with the common ink chamber at openings in the substrate at ends of the individual ink chambers opposite the one end at which the nozzle openings are formed in a longitudinal direction of the individual ink chambers.

4. A head chip according to claim 2; wherein the substrate comprises a base plate and sidewalls formed of a piezoelectric ceramic arranged on the base plate at a predetermined interval to define the individual ink chambers between the sidewalls, and the individual ink chambers and the common ink chamber communicate with each other at an end of the individual ink chambers opposite the one end at which the nozzle openings are formed in a longitudinal direction of the individual ink chambers.

5. A head chip according to claim 1; wherein the ink chamber plate has separate members forming the partitioning member and the communicating holes.

6. A head chip according to claim 5; wherein the substrate comprises a piezoelectric ceramic plate, and the individual ink chambers comprise grooves formed in the piezoelectric ceramic plate in communication with the common ink chamber at openings in the substrate at ends of the individual ink chambers opposite the one end at which the nozzle openings are formed in a longitudinal direction of the individual ink chambers.

7. A head chip according to claim 5; wherein the substrate comprises a base plate and sidewalls formed of a piezoelectric ceramic material arranged on the base plate at a predetermined interval to define the individual ink chambers between the sidewalls, and the individual ink chambers and the common ink chamber communicate with each other at an end of the individual ink chambers opposite the one end at which the nozzle openings are formed in a longitudinal direction of the individual ink chambers.

8. A head chip according to claim 1; wherein the substrate is formed of a piezoelectric ceramic plate, and the individual ink chambers comprise grooves formed in the piezoelectric ceramic plate to communicate with the common ink chamber at openings in the substrate at ends of the individual ink chambers opposite the one end at which the nozzle openings are formed in a longitudinal direction of the individual ink chambers.

9. A head chip according to claim 1; wherein the substrate comprises a base plate and sidewalls formed of a piezoelectric ceramic arranged on the base plate at a predetermined interval to define the individual ink chambers between the sidewalls, and the individual ink chambers and the common ink chamber communicate with each other at an end of the individual ink chambers opposite the one end at which the nozzle openings are formed in a longitudinal direction of the individual ink chambers.

10. A head chip according to claim 1; wherein the plurality of communicating holes further comprise a second communicating hole formed near an end of the respective individual ink chambers opposite the nozzle openings.

11. A print head chip comprising: a substrate defining a plurality of individual ink chambers for containing ink, each individual ink chamber having a nozzle at one end and an electrode for applying a voltage to the respective individual ink chamber to cause the ink to be ejected through the nozzle; a common ink chamber in communication with each of the plurality of individual ink chambers; and a partitioning member for creating a partition between the individual ink chambers and the common ink chamber and having a plurality of communicating holes opening to each of the respective individual ink chambers including first communicating holes for setting a pump length of the respective individual ink chambers based on a distance of the respective first communicating holes from the respective nozzles.

12. A print head chip according to claim 11; wherein the substrate comprises a piezoelectric substrate, the individual ink chambers comprise elongated grooves formed in the piezoelectric substrate, and the electrodes are disposed on sidewalls of the grooves in a longitudinal direction thereof such that a voltage applied by a respective electrode deforms a corresponding individual ink chamber to cause the ink contained therein to be ejected through the nozzle.

13. A print head chip according to claim 12; wherein the substrate comprises a base plate and piezoelectric members provided on the base plate spaced by a given interval to define the respective individual ink chambers, and the electrodes are disposed on sidewalls of the piezoelectric members in a longitudinal direction thereof such that a voltage applied by a respective electrode deforms a piezoelectric member of a corresponding individual ink chamber to cause the ink contained therein to be ejected through the nozzle.

14. A print head chip according to claim 11; wherein the plurality of communicating holes are positioned at a desired location to set a pump length of the respective individual ink chambers at a value required to achieve a desired printing speed.

15. A print head chip according to claim 11; wherein the plurality of communicating holes further comprise a second communicating hole formed near an end of the respective individual ink chambers opposite the nozzles.

16. A print head comprising: a head chip having a plurality of individual ink chambers for containing ink and a common ink chamber in communication with the plurality of individual ink chambers; a nozzle plate mounted to one end of the head chip and having a plurality of nozzle openings corresponding to the individual ink chambers; a plurality of electrodes provided on the head chip for causing the ink to be ejected from the individual ink chambers through the nozzle openings; and a partitioning plate for creating a partition between the common ink chamber and the individual ink chambers and having a plurality of communicating holes opening to each individual ink chamber for allowing communication between the common ink chamber and the respective individual ink chambers including first communicating holes spaced from the respective nozzle openings by a distance defining a pump length of the respective individual ink chambers, the distance being set to achieve a desired print speed.

17. A print head according to claim 16; further comprising a wiring substrate mounted to the head chip in contact with the plurality of electrodes.

18. A print head according to claim 16; wherein the head chip comprises a piezoelectric substrate, the individual ink chambers comprise elongated grooves formed in the piezoelectric substrate, and the electrodes are disposed on sidewalls of the grooves in a longitudinal direction thereof such that a voltage applied by a respective electrode deforms a corresponding one of the individual ink chambers to cause ink contained therein to be ejected through a corresponding nozzle opening.

19. A print head according to claim 16; wherein the head chip comprises a base plate and piezoelectric members provided on the base plate spaced by a given interval to define the respective chambers, and the electrodes are disposed on sidewalls of the piezoelectric members in a longitudinal direction thereof such that a voltage applied by a respective electrode deforms a piezoelectric member of a corresponding one of the individual ink chambers to cause ink contained therein to be ejected through a corresponding nozzle opening.

20. A print head according to claim 16; wherein the plurality of communicating holes further comprise a second communicating hole formed near an end of the respective individual ink chambers opposite the nozzle openings.

* * * * *